United States Patent [19]
Boothe
[11] 4,297,705
[45] Oct. 27, 1981

[54] FREQUENCY AGILITY TECHNIQUE FOR FREQUENCY SCANNED ANTENNA

[75] Inventor: Robert R. Boothe, Huntsville, Ala.

[73] Assignee: The United States of America as represented by the Secretary of the Army, Washington, D.C.

[21] Appl. No.: 126,516

[22] Filed: Mar. 3, 1980

[51] Int. Cl.[3] ..... H01Q 3/26; H01Q 13/10
[52] U.S. Cl. ..... 343/771; 343/854
[58] Field of Search ..... 343/768, 771, 854

[56] References Cited

U.S. PATENT DOCUMENTS

| | | | |
|---|---|---|---|
| 2,605,413 | 7/1952 | Alvarez | 343/854 |
| 2,676,257 | 4/1954 | Hebenstreit | 343/768 |
| 3,295,134 | 12/1966 | Lowe | 343/854 |
| 3,434,139 | 3/1969 | Algeo | 343/768 |

*Primary Examiner*—Eli Lieberman
*Attorney, Agent, or Firm*—Nathan Edelberg; Robert P. Gibson; Freddie M. Bush

[57] ABSTRACT

In a serpentine feed structure for a frequency scanned antenna a switching network is provided which allows the serpentine to be fed from either end on alternate or random scans. This variable transmission system significantly increases the frequency bandwidth that must be jammed by detrimental countermeasure systems. The feed switching network comprises first, second and third switching circulators coupled to receive radiant energy from a radar transmit-receive switch and selectively couple this energy to one or the other end of a serpentine feed structure for controlling the direction of electromagnetic radiation energy coupled through the serpentine structure. The serpentine feed structure supplies radiant energy to an antenna array of a frequency scanned antenna for controlling the sector scanning of the antenna. Reversing the direction of energy flow through the serpentine causes a change in the particular frequencies scanning a given sector of the scan. This allows two separated frequencies to be alternately used for directing a beam toward a particular direction thereby reducing the effects of countermeasure systems. Additionally, energy reflected from a target may be coupled back through the array and switching network to the radar transmit-receive circuitry.

3 Claims, 1 Drawing Figure

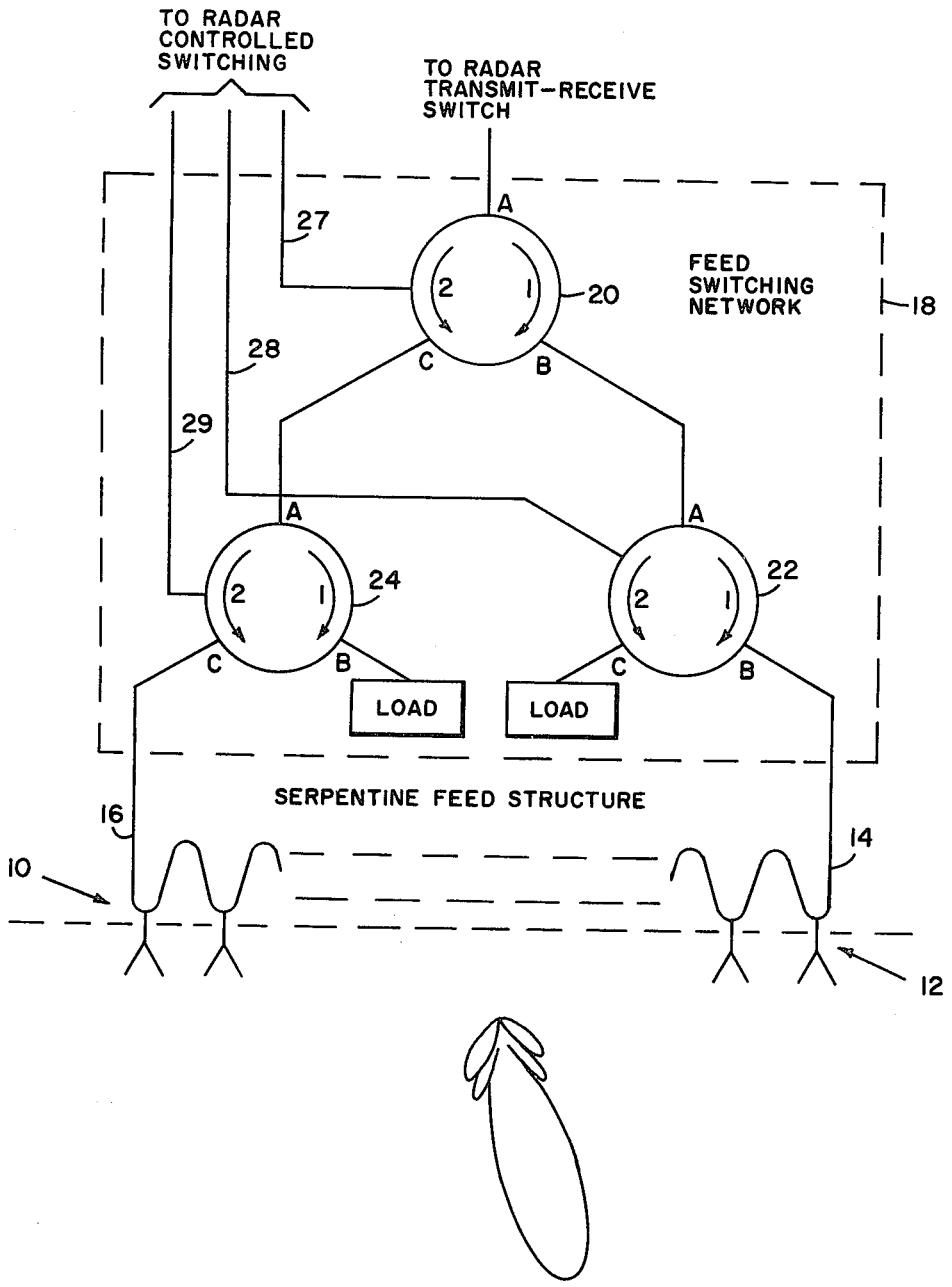
TO RADAR CONTROLLED SWITCHING
TO RADAR TRANSMIT-RECEIVE SWITCH
FEED SWITCHING NETWORK
18
20
22
24
27
28
29
A
B
C
1
2
LOAD
LOAD
SERPENTINE FEED STRUCTURE
10
12
14
16

FREQUENCY AGILITY TECHNIQUE FOR FREQUENCY SCANNED ANTENNA

The invention described herein may be manufactured, used, and licensed by or for the Government for governmental purposes without the payment to me of any royalties thereon.

SUMMARY OF THE INVENTION

Frequency scanned antennas are currently fed from only one end, thereby producing a direct correlation between beam pointing angle and frequency. Use of circulator switches and a serpentine feed structure provides an alternate method of feeding the radiating elements in order to provide a different frequency-angle relationship. Feeding a serpentine from opposite ends alternately or randomly, allows a sector being scanned to be scanned by separate and distinct frequency beams, thereby reducing electronic countermeasures jamming. Located between a radar transmit-receive circuit and the antenna radiating elements of a frequency scanned antenna a serpentine feed structure is disposed for feeding the antenna radiating elements. A feed switching network utilizes circulator switches to direct the radar transmitted frequency selectively to one or the other ends of the serpentine feed structure by changing the path of transmitted energy through the circulators. During the receive mode, the circulator switches are set to receive energy from the same ends of the serpentine feed structure that was used during transmission.

BRIEF DESCRIPTION OF THE DRAWING

The single FIGURE is a diagrammatic illustration of a serpentine and feed switching network for providing the frequency agility technique in a radar system.

DESCRIPTION OF THE PREFERRED EMBODIMENT

Referring now to the single FIGURE, a serpentine feed structure 10 is adapted for providing an array of outputs to an array of antenna radiating elements 12 in accordance with procedures well established in the art. A switching network is coupled to inputs 14 and 16 of serpentine feed structure 10 for providing radar transmit-receive signals thereto. Feed switching network 18 is comprised of circulators 20, 22 and 24, which are switching circulators. Circulators 20, 22, and 24 are shown having input-output ports A, B, and C for directing energy to and from the circulators. Port A of circulator 20 is adapted for coupling to the radar transmitt-receive switch (not shown) for coupling radar energy to and from the antenna radiating elements. Port B of circulator 20 is coupled to port A of circulator 22 and port C of circulator 20 is coupled to port A of circulator 24. Port B of circulator 22 is coupled to the serpentine feed structure input 14 and port C of circulator 24 is coupled to the serpentine feed structure input 16. Port C of circulator 22 and port B of circulator 24 are coupled to load circuits for terminating any energy that may remain in the system after the energy has passed through serpentine feed structure 10. There are two paths of energy flow through each circulator. These paths may be identified as mode 1 and mode 2 with an arrow indicating the direction of signal passage through the circulator. Thus, for example, when circulator 20 is in mode 1 energy during transmission is directed from port A to port B and during reception energy is directed from port C through the circulator to port A. In mode 2 energy is directed on transmission from port A to port C and on reception from port B to port A. The direction of signal passage through the respective circulators is controlled by activating switching means such as a switching coil within each circulator. This control or gating signal is represented typically by inputs 27, 28, and 29 coupled between respective circulators 20, 22 and 24 and a radar controller switching circuit. The controller (not shown) provides only a switching voltage at selective intervals to the circulators for controlling the path of signal flow and provides the same effect as a human operator actually closing or opening a mechanical switch to change the circuit condition except that it operates at higher speeds. In a radar system the controller normally controls the sync, timing, and transmit-receive switching of the system.

Frequency-scanned antenna arrays are well known in the art. Typical teachings respecting such arrays are shown in the "Radar Handbook" by M. I. Scholnick, McGraw-Hill Book Company, 1970. Antenna concepts are taught in Section 13.3, pages 13-9 through 13-16, Section 13.5 on pages 13-23 through 13-26 which show extensive use of serpentines for feeding an antenna array. A conventional frequency scanned antenna which utilizes the serpentine feed structure does not possess true frequency agility, although a fairly wide range of transmitted frequencies are utilized to achieve scanning of the beam. This is due to the fact that a particular transmitted frequency specifies an exact angle which the beam is to be directed, and the arbitrary choice of transmitted frequency for any beam angle is not available to the radar system controller. Thus, a radar employing frequency scanning of a beam over elevation angles can only utilize a fraction of its total bandwidth over a specified sector such as the lower elevation angles, for example, below 2° or 3°. Therefore, if it is desired to prevent detection of low altitude targets present in such a specified sector it is only necessary to provide noise jamming over a reduced bandwidth that applies to those particular frequencies required to steer or direct the antenna beam to the lower elevation angles.

In overcoming this deficiency of serpentine fed frequency scanned antennas and to provide countermeasures to jamming, a switching arrangement is provided which allows the serpentine to be fed from either end, either on alternate scans or in a random manner. This switching arrangement for the serpentine feed allows reversing the relationship between the transmitted frequency and the angle to which the beam is directed. On one scan the low elevation beams are at one end of the frequency bandwidth, on another scan they are at the other end of the frequency bandwidth. This changes the particular frequency which scans each sector and thereby prevents or reduces jamming.

This technique causes the radar's opponent utilizing electronic countermeasures (ECM) to cover a much broader band of frequencies during jamming attempts and thereby reduces his effective radiated power density. This reduction in power density reduces the ECM effectiveness and increases the burn through capability (detection or lock-on range) of the radar.

In operation of the system, switch 18 may be operated at random intervals to momentarily or periodically change the transmission mode such that transmission and reception is along path 14 to the serpentine or along path 16 to the serpentine. For transmission through path 14, energy is allowed to flow from the transmit-receive switch through path 1 of circulator 20, path 1 of circulator 22, and path 14 to one end of the serpentine during transmission. When reflected energy is being received back through the antenna 12 to the serpentine 10, the energy is coupled through path 14, path 2 of circulator 22 and path 2 of circulator 20 to the radar receiver. Line 16 or waveguide path 16 is terminated in a load during this switch condition. In the alternate mode of operation, during transmission energy is allowed to flow through path 2 of circulator 20 and path 2 of circulator 24 through line 16 to the serpentine and back through line 16 and paths 1 of circulators 24 and 20 to the receiver during the reception. During this alternate switch condition line 14 is terminated through circulator 22 in a load. The switch modes of the circulators are shown in Table 1 for the two transmit and two receive conditions required to alternately or randomly feed the serpentine through lines 14 and 16.

TABLE 1

| Condition | Circulator Switch Mode | | |
|---|---|---|---|
| | 20 | 22 | 24 |
| Transmit through path 14 | 1 | 1 | 2 |
| Receive through path 14 | 2 | 2 | 2 |
| Transmit through path 16 | 2 | 1 | 2 |
| Receive through path 16 | 1 | 1 | 1 |

Circulator switches are produced by various manufacturers. One such circulator switch is made by Alpha Industries, Incorporated, model number MT2404 which operates at S-band frequencies. These devices are typically constructed to customer specifications with respect to frequency range, insertions loss, VSWR, and power handling capabilities.

Serpentine feed structures are usually designed to provide an amplitude taper in order to achieve good sidelobes in the feed plane dimension. Feeding the serpentine structure from the opposite end than it is normally fed will cause some degradation of the sidelobes in the feed plane dimension, but not in the orthogonal plane. This degradation in sidelobes is on the order of 5 decibels and still results in an acceptable pattern. It will also cause a broadening of the skirts of the main beam, however this occurs considerably below the peak of the pencil beam. For example in the region of 30 db down from the peak, the beam broadens by a factor of about two. Thus in a standoff jamming environment, wherein the radar is attempting to detect or track a target in a given sector of the scan coverage while jamming countermeasures are present at that frequency, switching from one input of the serpentine feed to the other input results in beams of different frequencies now being directed toward the given sector. This eliminates or substantially reduces the main beam jamming at the original frequency to permit search or track with minimum interference in the respective sectors.

An advantage of this frequency agility technique is that in a standoff jamming environment, the jamming cannot be limited to just one frequency region required to direct antenna beams at particular elevation angles. The frequency agility technique allows beams to be directed towards those same elevation angles with different selectable frequencies which reduces jamming effectiveness.

Our methods of alternately feeding the two ends of the serpentine may be envisioned by those knowledgeable in the art, all having the same effect of reversing the relationship between transmitted frequencies and the angle to which the antenna beam is directed. Therefore it is to be understood that the form of the invention, herewith shown and described is to be taken as the preferred example of the same, and that various changes in the arrangement of parts may be resorted to, without departing from the spirit and scope of the invention. Accordingly, the scope of the invention is to be limited only by the claims appended hereto.

I claim:

1. A frequency agility circuit for a frequency scanned antenna comprising: bidirectional switching means adapted for coupling electromagnetic radiation therethrough, said switching means being adapted for receiving energy from a source of electromagnetic radiation; a serpentine feed structure coupled to said switching means for directing electromagnetic radiation bidirectionally therethrough, said serpentine feed structure being adapted for coupling said radiation to and from a frequency scanned antenna array, and said serpentine feed structure having first and second feed inputs for directing energy bidirectionally therethrough; and wherein said switching means comprises first, second, and third microwave circulators, each circulator having first, second, and third input-output ports, said first port of the first circulator being adapted for receiving energy from a radiation source, said second circulator having the first input-output port coupled to said second port of the first circulator and having the second port coupled to the first input of said serpentine feed structure, said third circulator having the first port coupled to said third port of the first circulator and having the third input-output port coupled to the second input of said serpentine feed structure; and further comprising a load circuit coupled to the third port of said second circulator and to the second port of said third circulator for absorbing residual energy.

2. A frequency agility circuit for a frequency scanned antenna as set forth in claim 1 wherein said circulators are switching circulators for selectively reversing the direction of energy flow through said serpentine feed structure and thereby changing the serpentine feed structure output coupled radiation.

3. A frequency agility circuit for a frequency scanned antenna as set forth in claim 2 and further comprising an array antenna coupled to said serpentine feed structure for scanning a beam of energy in response to feed from said serpentine feed structure, said beam changing in both frequency and directionof scan for each scan sector of the antenna in response to the reversal of energy flow through said serpentine feed structure.

* * * * *